US006516650B1

(12) United States Patent
Watanabe

(10) Patent No.: US 6,516,650 B1
(45) Date of Patent: Feb. 11, 2003

(54) ROLLING DIES FOR PRODUCING DOG POINT THREADS

(75) Inventor: Yoshitaka Watanabe, Toyokawa (JP)

(73) Assignee: OSG Corporation, Aichi (JP)

( * ) Notice: Subject to any disclaimer, the term of this patent is extended or adjusted under 35 U.S.C. 154(b) by 172 days.

(21) Appl. No.: 09/718,920

(22) Filed: Nov. 22, 2000

(30) Foreign Application Priority Data

May 26, 2000 (JP) ..... 12-155734

(51) Int. Cl.[7] ..... B21H 3/06
(52) U.S. Cl. ..... 72/469; 72/88
(58) Field of Search ..... 72/469, 88, 90

(56) References Cited

U.S. PATENT DOCUMENTS 3,426,820 A * 2/1969 Phipard ..... 411/310
3,803,889 A * 4/1974 Muenchinger ..... 72/88
3,978,760 A * 9/1976 Muenchinger ..... 411/386
4,037,281 A * 7/1977 Reynolds ..... 72/88
4,042,342 A * 8/1977 Muenchinger ..... 411/394
4,561,277 A * 12/1985 Taubert et al. ..... 72/469
4,793,219 A 12/1988 Wozniak
4,862,718 A 9/1989 LaCroix
6,135,892 A * 10/2000 Donovan ..... 72/88

FOREIGN PATENT DOCUMENTS

GB 1438475 6/1976
JP 9-122809 5/1997

* cited by examiner

*Primary Examiner*—Daniel C. Crane
(74) *Attorney, Agent, or Firm*—Muramatsu & Associates

(57) ABSTRACT

A thread rolling dies for producing dog point threads is capable of preventing slips of an outer surface of screw blank when rolling, thereby avoiding breakage of the dog point thread. The dog point thread has a thread portion provided with external threads and a dog point having an outer diameter smaller than an outer diameter of the thread portion. The thread rolling dies is configured with a thread portion rolling surface having a thread portion dies ridge for forming a groove of the thread portion of the dog point thread and a thread portion dies groove for forming a ridge of the thread portion of the dog point thread, and a dog point rolling surface provided in parallel with the thread rolling surface and having a dog point dies ridge for forming a groove on the dog point of the dog point thread and a dog point dies groove for forming a ridge on the dog point of the dog point thread.

5 Claims, 4 Drawing Sheets

ROLLING DIES FOR PRODUCING DOG POINT THREADS

FIELD OF THE INVENTION

This invention relates to a rolling dies for producing dog point threads each having a thread portion provided with external threads and a dog point having a diameter smaller than that of the thread portion through a plastic deformation process by rolling an outer surface of a screw blank. More specifically, this invention relates to a thread rolling flat dies for producing dog point threads which is capable of preventing slipping of outer surface of the screw blank when rolling the screw blank, thereby avoiding breakage of external threads or the like of the thread portion.

BACKGROUND OF THE INVENTION

A dog point thread has a thread portion provided with external (male) threads and a dog point of cylindrical shape provided at the end of the thread portion where a diameter of the dog point is smaller than that of the thread portion. For producing such a dog point thread, for example, a pair of thread rolling flat dies is used to plastic deform an outer surface of a work or screw blank thereby forming the thread portion and the dog point at the same time. One surface of the rolling dies has a thread portion rolling surface formed with a plurality of ridges and grooves for forming the thread portion of the dog point thread and a flat surface continuous to the thread portion rolling surface having a flat surface for forming the dog point of the dog point thread.

In the conventional thread rolling flat dies, however, since the area for forming the dog point of the dog point thread has the flat surface as noted above, the outer surface of the screw blank (work) contacting the flat surface tends to slip during the rolling. Thus, there is a problem that the slip during the rolling causes damages or irregularity of the external (male) thread formed by the rolling dies.

SUMMARY OF THE INVENTION

This invention has been made to solve the above noted problems arises in producing the dog point thread in the production method involved in the conventional technology.

It is, therefore, an object of the present invention to provide a thread rolling dies for producing dog point threads which is capable of preventing the outer surface of the screw blank from slipping during the rolling, thereby avoiding breakage of external threads or the like on the thread portion of the dog point thread.

It is another object of the present invention to provide a thread rolling dies for producing dog point threads with high production efficiency by forming a dog point thread with a rolling pressure less than a rolling pressure applied to a thread portion of the dog point thread.

It is a further object of the present invention to provide a thread rolling dies for producing dog point threads each being capable of smoothly guiding a nut or the like having internal thread toward a thread portion of the dog point thread.

In the first aspect of the present invention, the thread rolling dies is to produce a dog point thread by plastic deforming an outer surface of a screw blank where the dog point thread has a thread portion provided with external threads and a dog point having an outer diameter smaller than an outer diameter of the thread portion. The thread rolling dies is comprised of a thread portion rolling surface having a thread portion dies ridge for forming a groove of the thread portion of the dog point thread and a thread portion dies groove for forming a ridge of the thread portion of the dog point thread, and a dog point rolling surface provided in parallel with the thread rolling surface and having a dog point dies ridge for forming a groove of the dog point of the dog point thread and a dog point dies groove for forming a ridge of the dog point of the dog point thread. A crest of the dog point dies ridge is positioned higher than a crest of the thread portion dies ridge, and a root of the dog point dies groove is positioned lower than a root of the crest of the thread portion dies ridge, and a distance between the crest and root of the dog point dies ridge is smaller than a distance between the crest and root of the thread portion dies ridge.

According to the first aspect of the present invention, the dog point of the dog point thread is formed by the dog point rolling surface of the rolling dies by rolling the dog point dies ridges and dog point dies grooves on the outer surface of the work (screw blank) at the same time. In the thread rolling dies of the present invention, the crest of the dog point thread (dies) ridge is designed higher than the crest of the thread portion (dies) ridge. Further, the root of the dog point thread (dies) groove is designed lower than the crest of the thread portion (dies) ridge. Since the ridge height of the dog point thread ridge is shorter than the ridge height of the thread portion ridge as noted above, the resultant ridge height of the dog point thread is shorter than the ridge height of the thread portion ridge of the dog point thread.

In the second aspect of the thread rolling dies of the present invention for producing the dog point thread, a pitch and a lead angle of the dog point rolling surface are designed approximately equal to a pitch and a lead angle of the thread portion surface.

In the third aspect of the thread rolling dies of the present invention for producing the dog point thread, a difference of height between the crest of the dog point dies ridge and the crest of the thread portion dies ridge pitch is designed larger than about 0.05 mm and is smaller than about a half of the distance between the crest and root of the thread portion dies ridge, and a difference of height between the root of the dog point dies groove and the crest of the thread portion dies ridge is designed larger than about 0.05 mm and is smaller than about a half of the distance between the crest and root of the thread portion dies ridge.

In the fourth aspect of the present invention, the thread rolling dies for producing the dog point thread includes a cut-out groove in a boarder area between the thread portion rolling surface and the dog point rolling surface wherein the cut-out groove connects the root of the thread portion dies groove and the root of the dog point dies groove by upwardly inclining therebetween.

Therefore, the cut-out groove on the rolling dies functions to produce the boarder area between the dog point and thread portion of the dog point thread. As noted above, the cut-out groove upwardly inclines from the root of the thread portion groove to the root of the dog point groove. Thus, the dog point thread produced by the rolling dies, at the boarder area between the dog point and the thread portion, the height of the ridge of the dog point gradually increases toward the ridge of the thread portion.

In the fifth aspect of the thread rolling dies of the present invention for producing the dog point thread, width of the cut-out groove gradually decreases from the root of the thread portion dies groove to the root of the dog point dies groove.

Therefore, the cut-out groove on the rolling dies functions to produce the boarder area between the dog point and thread portion of the dog point thread. As noted above, the width of the cut-out groove gradually decreases from the root of the thread portion groove to the root of the dog point groove. Thus, the dog point thread produced by the rolling dies, at the boarder area between the dog point and the thread portion, the width of the ridge of the dog point gradually increases toward the ridge of the thread portion.

BRIEF DESCRIPTION OF THE DRAWINGS

FIG. 3 shows a cross sectional view taken along the III—III line of FIG. 1(*a*).

DETAILED DESCRIPTION OF THE PREFERRED EMBODIMENTS

Figure 1A:
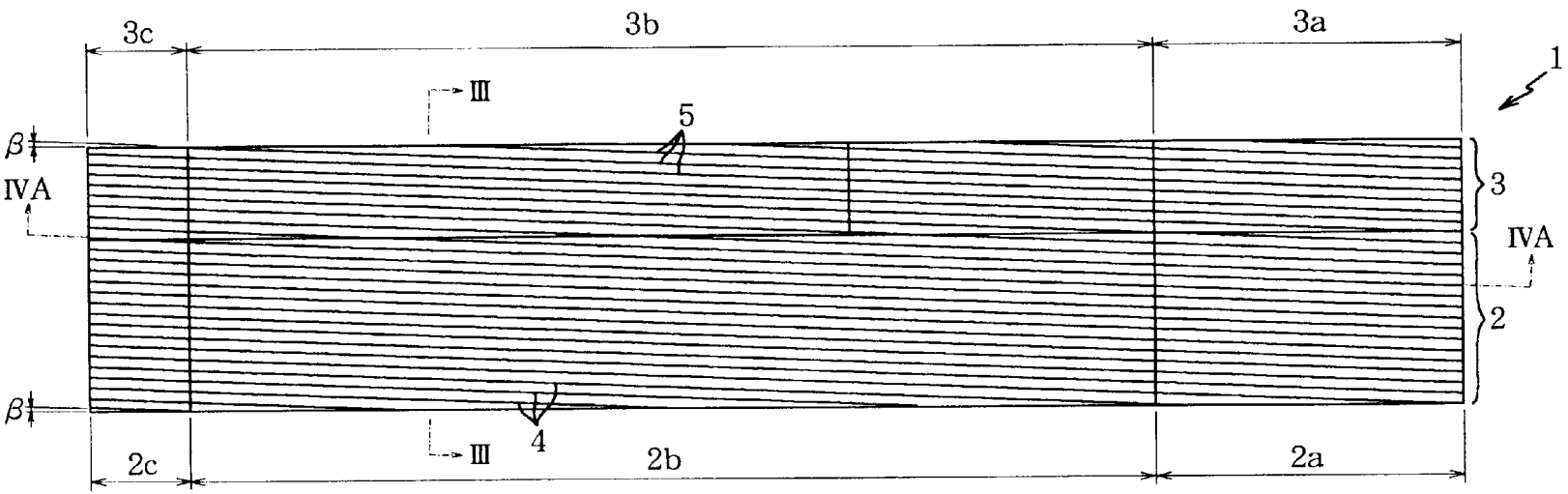
FIG. 1(*a*) is a plan view of the thread rolling flat dies showing an embodiment of the present invention for producing the dog point threads and FIG. 1(*b*) is a front view of the embodiment of FIG. 1(*a*).
Figure 1B:
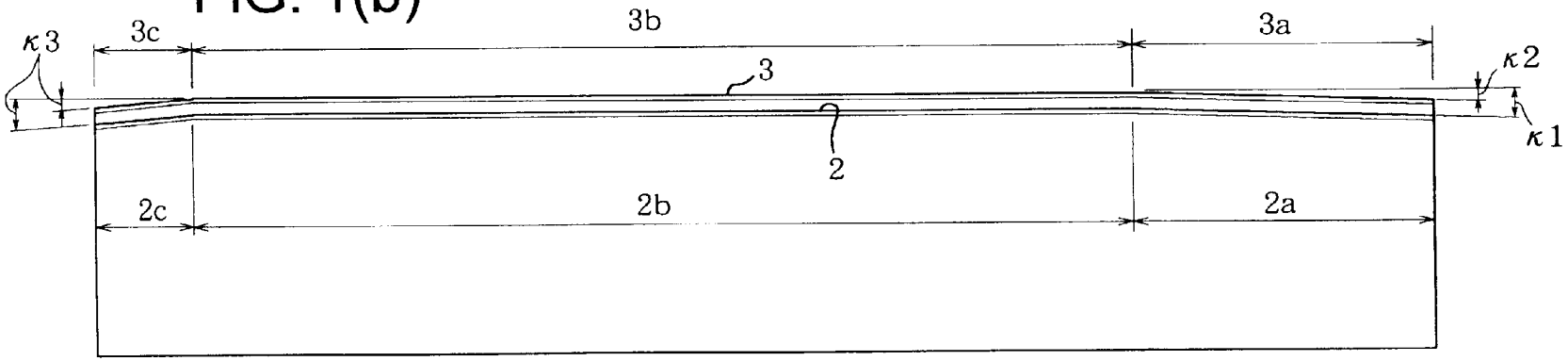

The thread rolling flat dies will be described in detail with reference to the accompanying drawings which show the preferred embodiments of the present invention wherein like numerals refer to like parts throughout. A plan view of the thread rolling flat dies (hereafter, may also "rolling dies" ) of the present invention for dog point threads is shown in FIG. 1(*a*) and a front view of the rolling dies is shown in FIG. 1(*b*). It should be noted that, in FIGS. 1(*a*) and 1(*b*), only one of the pair of dies 1, which is fixedly provided on a rolling table (not shown), is illustrated, and thus, the other dies which reciprocally moves in parallel with the fixed dies is not shown in the drawings.

Figure 2A:
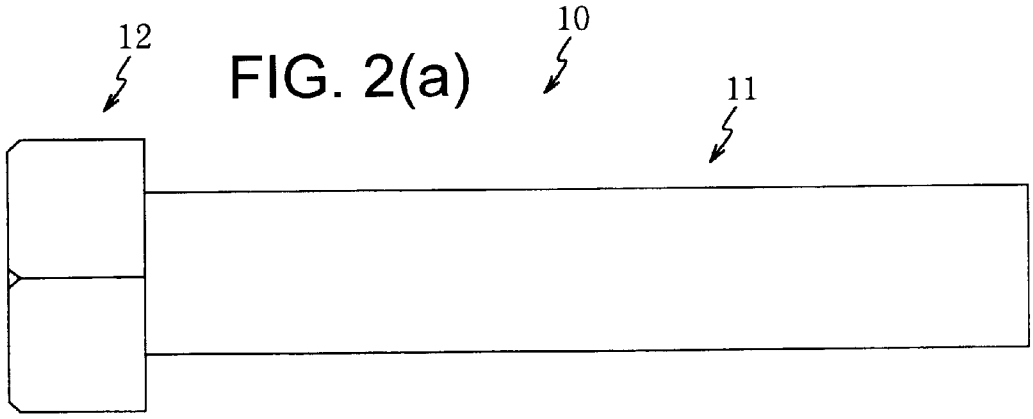
FIG. 2(*a*) is a front view of the screw blank before the rolling process, FIG. 2(*b*) is a front view of an example of dog point thread produced through the rolling process, and FIG. 2(*c*) is an enlarged view of the dog point of the dog point thread of FIG. 2(*b*).
Figure 2B:
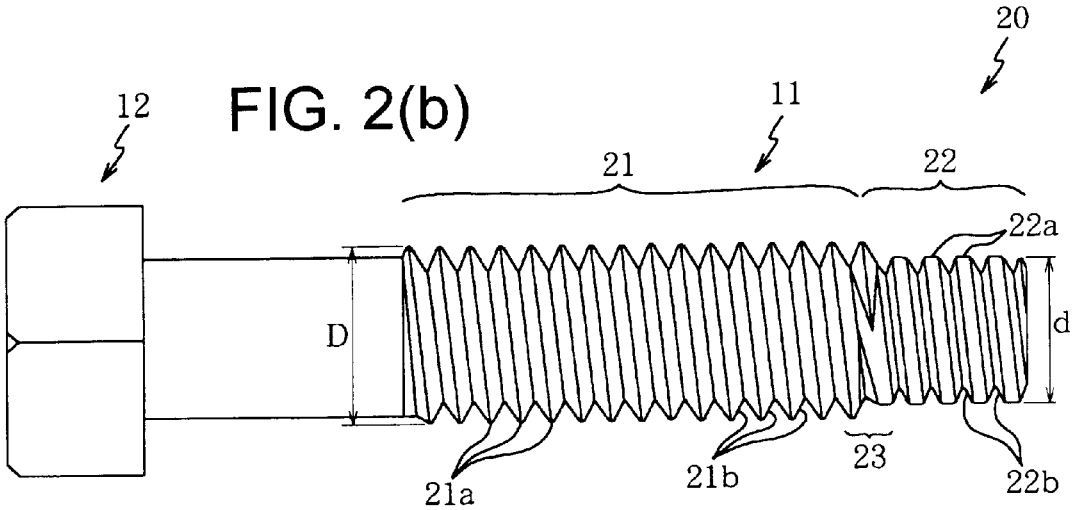
Figure 2C:
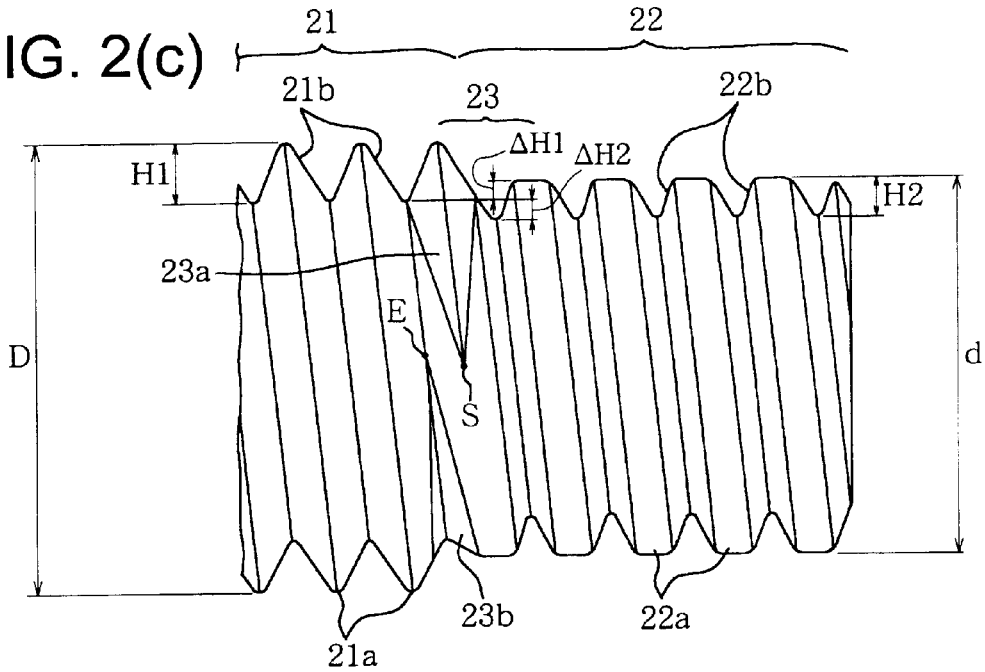

The rolling dies 1 is a tool for forming a dog point thread having a thread portion and a dog point on the outer surface of the screw blank (rod like material or work 10) of FIG. 2(*a*) by plastic deforming the blank. As shown in FIGS. 2(*b*) and 2(*c*), the dog point thread 20 has an external (male) thread portion (hereafter "thread portion") 21 and a dog point 22 formed through the rolling process using the rolling dies 1.

In the following, descriptions will be made as to the rolling dies 1 of the present invention for producing, as an example, a metric coarse thread, particularly, a male dog point thread of type "M 8×1.25", defined in International Organization for Standardization ISO 724.

First, referring to FIGS. 2(*a*)–2(*c*), the work 10 to be processed by the rolling dies 1 and the dog point thread 20 produced from the work 10 will be briefly explained. FIG. 2(*a*) is a front view of the work (screw blank) 10 before being rolled between the rolling dies 1, and FIG. 2(*b*) is a front view of the dog point thread 20 produced after the rolling. Further, FIG. 2(*c*) is an enlarged view of the dog point thread 20 of FIG. 2(*b*) showing the details on the surface of the dog point 22.

As shown in FIG. 2(*a*), the work 10 is an unthreaded shank having a cylindrical body 11 and a hexagon head 12 at one end of the cylindrical body 11. On the outer surface of the cylindrical body 11 of the work 10, the thread portion 21 and the dog point 22 are formed at the same time through the rolling using the rolling dies 1.

The dog point thread 20 is one of hexagon head dog point screws as shown in FIG. 2(*b*). The dog point thread 20 has the thread portion 21 and the dog point 22 formed on the outer surface of the cylindrical body 11 of the work 10 by the rolling dies 1 at the same time. The thread portion 21 has thread portion ridges 21*a* and thread portion grooves 21*b* in a spiral fashion while the dog point 22 has dog point ridges 22*a* and dog point grooves 22*b* in a spiral fashion.

The thread portion 21 and the dog point 22 are abut on each other via a boarder area 23. An outer diameter D of the thread portion 21 is larger than an outer diameter d of the dog point 22, i.e., D)d. Thus, when the dog point thread 20 is screwed in an internal thread of a nut, for example, by inserting the dog point 22 in the nut, the dog point 22 guides the nut toward a start point S of the thread portion ridges 21*a,* i.e., a left direction of FIG. 2(*b*).

As shown in FIG. 2(*c*), thread height (basic thread height) H1 of the thread portion ridges 21*a* is greater than thread height (basic thread height) H2 of the dog point ridges 22*a,* i.e, H1)H2. A crest (peak) of the dog point ridge 22*a* is higher than a root of the thread portion groove 21*b* by a difference of ΔH1, and a root of the dog point groove 22*b* is lower than the root of the thread portion groove 21*b* by a difference of ΔH2. Further, a pitch and a lead angle of the dog point groove 22*b* is substantially the same as a pitch and a lead angle of the thread portion groove 21*b,* and a thread angle of the dog point ridge 22*a* is substantially the same as a thread angle of the thread portion ridge 21*a.*

According to the dog point thread 20 configured as described in the foregoing, even when the dog point 22 is inserted into the inner thread of the nut in an inclined manner, the dog point ridges 22*a* and the dog point grooves 22*b* engage the grooves and ridges of the nut, thereby being able to smoothly guide the nut toward the thread portion 21. Moreover, since the outer diameter d of the dog point 22 is smaller than the outer diameter D of the thread portion 21, a small gap is attained between the dog point ridges 22*a* or dog point grooves 22*b* and the grooves and ridges of the nut. Accordingly, when the dog point 22 is inserted into the inner thread of the nut with a tilted angle, it is able to avoid the dog point 22 from burning within the nut.

Figure 3:
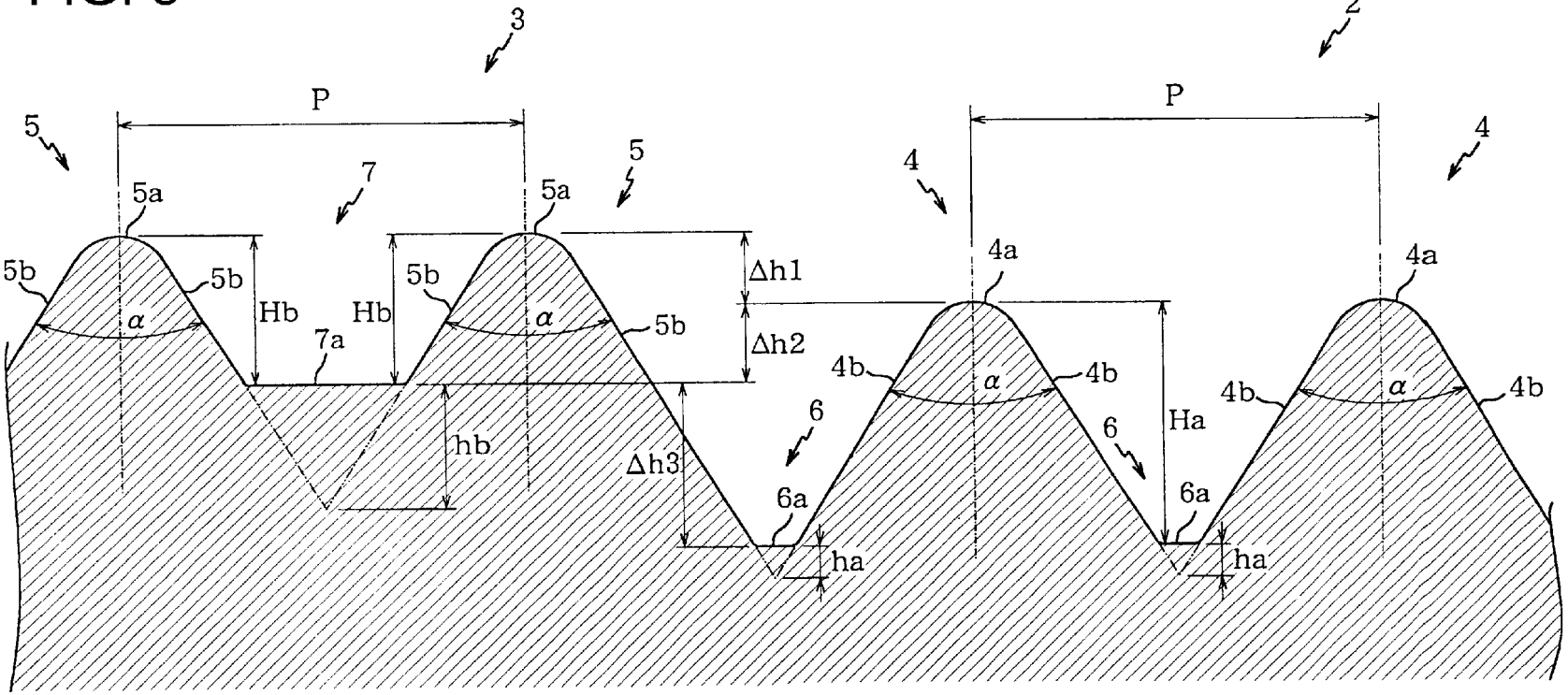
FIG. 3 is an enlarged partial cross sectional view of the thread rolling flat dies of the present invention having a thread portion rolling surface and a dog point rolling surface.

As shown in FIG. 3(*c*), the boarder area 23 between the thread portion 21 and the dog point 22 is provided with a start point S of the thread portion ridge 22*a* and an end point E of the dog point groove 22*b.* The start point S of the thread portion ridge 21*a* is in the proximity with the end point E of the dog point groove 22*b* and on the crest of the dog point ridge 22*a.* In the boarder area 23, from the start point S to the thread portion 21, i.e., toward the left of FIG. 2(*c*), a boarder ridge 23*a* is provided in a spiral fashion in which ridge height and ridge width gradually increase. Namely, the crest of the dog point ridge 22*a* gradually increases outwardly until the thread portion ridge 21*a.* Further, in the boarder area 23, from the dog point 22, to the end point E, a boarder groove 23*b* is provided in a spiral fashion in which groove depth and groove width gradually decrease in the left direction.

As noted above, because the boarder ridge 23*a* and the boarder groove 23*b* are formed in the boarder area 23, in the case where the dog point 22 is inserted in the nut in an inclined manner, such an inclination of the dog point 22 is corrected and is straightened relative to the nut. Further, because the ridge height and ridge width of the boarder ridge 23*a* gradually increase from the start point S of the thread portion ridge 21*a,* the burning of the dog point 22 caused by engagement between the boarder ridge 23*a* and the internal threads of the nut can be prevented even when the dog point is obliquely inserted in the nut.

Referring back to FIG. 1, the thread rolling dies 1 has a rectangular shape and is made of appropriate material such as alloy tool steel or high speed tool steel. The thread rolling dies 1 has, mainly on the front surface thereof, a thread rolling surface 2 and a dog point rolling surface 3 in parallel with each other. The thread rolling surface 2 is to produce the thread portion 21 (FIG. 2(*b*)) on the cylindrical body 11 (FIG. 2(*a*)) of the work 10. The dog point rolling surface 3 is to produce the dog point 22 (FIG. 2(*b*)) on the cylindrical body 11 (FIG. 2(*a*)) of the work 10.

The thread rolling surface 2 has a chamfer 2*a* at a longitudinal end, i.e., the right side of FIG. 1, of the thread rolling dies 1. The chamfer 2*a* has an upward inclination from the start to the chamfer end (from the right end to the left direction of FIG. 1) with a predetermined chamfer angle k1. Typically, the chamfer angle k1 is about 1° 40' (1 degree 40 minutes) for the stationary dies 1 and about 0 (zero) degree for the moving dies 1.

The thread rolling surface 2 of the rolling dies 1 also has a finishing part 2*b* which is continuous with the end of the chamfer 2*a* at the right side of FIG. 1 and a run off 2*c* which is continuous with the end of the finishing part 2*b* at the left side of FIG. 1. The run off 2*c* has an downward inclination from the start thereof to the end (in the left direction of FIG. 1) with a predetermined run off angle k2. Typically, the run off angle k2 is about 3°00'(3 degree zero minutes) for the stationary dies 1 and about 0 (zero) degree for the moving dies 1.

The thread rolling surface 2 having the chamfer 2*a,* the finishing part 2*b* and the run off 2*c* as noted above is formed of a plurality of thread portion ridges (thread portion dies ridges) 4. The thread portion ridges 4 are continuously formed from the start of the chamfer 2*a* (right end of FIG. 1) to the end of the run off 2*c* (left end of FIG. 1). The plurality of thread portion ridges 4 have a lead angle β relative to the longitudinal direction of the thread rolling dies 1 in an inclined fashion from the start of the chamfer 2*a* to the end of the run off 2*c*. The lead angle β is approximately the same as a lead angle of the thread portion 21 of the dog point thread 20 (FIG. 2(*b*)), which is for example, 3°10'(3 degree 10 minutes).

As noted above, the dog point rolling surface 3 is to produce the dog point 22 (FIG. 2(*b*)) on the cylindrical body 11 (FIG. 2(*a*)) of the work 10. The dog point rolling surface 3 is substantially in the same longitudinal direction of the thread rolling surface 2. The dog point rolling surface 3 has a chamfer 3*a* at a longitudinal end (right side of FIG. 1) of the thread rolling dies 1. The chamfer 3*a* has an upward inclination from the start to the chamfer end (from right end of FIG. 1 to the left direction) with a predetermined chamfer angle k2.

The chamfer angle k2 is larger than the chamfer angle k1 of the thread rolling surface 2, i.e, k2) k1. Consequently, the dog point rolling surface 3 can lead in the outer surface of the work 10 more easily compared to the thread rolling surface 3. Typically, the chamfer angle k1 is about 2°00' (2 degree zero minutes) for the stationary dies 1 and about 0 (zero) degree for the moving dies 1.

The dog point rolling surface 3 has a finishing part 3*b* which is continuous with the end of the chamfer 3*a* at the right side of FIG. 1 and a run off 3*c* which is continuous with the end of the finishing part 3*b* at the left side of FIG. 1. The run off 3*c* has, similar to the run off 2*c* on the thread rolling surface 2, an downward inclination from the start thereof to the end (left end of FIG. 1) with a predetermined run off angle k3.

The dog point rolling surface 3 having the chamfer 3*a,* the finishing part 3*b* and the run off 3*c* as noted above is formed of a plurality of dog point thread ridges (dog point dies ridges) 5. The dog point thread ridges 5 are continuously formed from the start of the chamfer 3*a* (right end of FIG. 1) to the end of the run off 3*c* (left end of FIG. 1). The plurality of dog point thread ridges 5 have a lead angle β relative to the longitudinal direction of the thread rolling dies 1 in an inclined fashion from the start of the chamfer 3*a* to the end of the run off 3*c*. The lead angle β is approximately the same as the lead angle β of the thread portion ridges 4 of the thread rolling surface 2. Thus, the lead angles of the thread portion 21 and dog point 22 formed on the outer surface of the work 10 by the rolling thread dies 1 can be virtually identical to each other.

FIG. 3 is an enlarged partial cross sectional view of the rolling dies of the present invention. FIG. 3 shows a cross sectional view of the thread portion ridges 4 and the dog point thread ridges 5 obtained by cutting the thread rolling surface 2 and the dog point rolling surface 3 in perpendicular to the direction of the ridges 4 and 5 having the lead angle β noted above, i.e., along the III—III line of FIG. 1(*a*). As shown in FIG. 3, the thread rolling surface 2 of the thread rolling dies 1 is provided with the plurality of thread portion ridges 4 of trapezoidal shape in cross section with a pitch (distance between two adjacent crests) P, which is, for example, 1.25 mm.

Each of the thread portion ridges 4 has a crest (peak) 4*a* at its top with an arc like shape and at its both sides, a pair of flanks 4*b* each being an inclined surface. In the thread portion ridges 4, each of the flanks 4*b* has a predetermined angle of inclination, i.e, a thread angle α, an example of which is about 60°. The height of the thread portion ridges 4, i.e., a distance between a root 6*a* of the groove (described later) and the crest 4*a,* i.e., a basic ridge height Ha, an example of which is about 0.677 mm.

The thread rolling surface 2 includes a plurality of thread portion grooves (thread portion dies grooves) 6 each being a V-shaped space positioned between two thread portion ridges 4 for forming the thread portion ridges 21*a* on the thread portion 21 of the dog point thread 20. The thread portion grooves 6 is provided between the two opposite flanks 4*b* of the adjacent thread portion ridges 4. At the bottom of each thread portion groove 6, the root 6*a* of a flat surface is provided to form the crest 21*a* of the thread portion 21.

Similarly, as shown in FIG. 3, the dog point rolling surface 3 of the thread rolling dies 1 is provided with the plurality of dot point thread ridges 5 of trapezoidal shape in cross section with a pitch (distance between two adjacent crests) P, which is, for example, 1.25 mm.

Each of the dog point thread ridges 5 has a crest (peak) 5*a* at its top with an arc like shape and a pair of flanks 5*b* at its both sides each of which is an inclined surface. The thread portion groove 6 between the thread portion ridge 4 and the dog point thread ridge 5 is formed between the flank 4*b* of the thread portion ridge 4 and the flank 5*b* of the dog point thread ridge 5 facing each other.

In the dog point thread ridges 5, each of the flanks 5*b* has a predetermined angle of inclination, i.e, a thread angle α, which is identical to the thread angle of the flanks 4*b,* i.e., about 60°. The height of the dog point thread ridges 5, i.e., a distance between a root 7*a* of the groove 7 (described later) and the crest 5*a,* is called a basic ridge height Hb, an example of which is about 0.332 mm.

Since the ridge height Hb of the dog point thread ridge 5 is shorter than the ridge height Ha of the thread portion ridge 4 as noted above, the ridge height H2 of the dog point thread 22*a* is shorter than the ridge height H1 of the thread portion ridge 21*a* of the dog point thread 20. Accordingly, in the rolling, the pressure (rolling amount) applied to the dog point thread ridge 5 on the work 10 is smaller than the pressure (rolling amount) applied to the thread portion ridge 4, thereby reducing the load required for producing the dog point threads 20.

The thread rolling surface 3 includes a plurality of dog point thread grooves (dog point dies grooves) 7 each being a V-shaped space positioned between two adjacent dog point thread ridges 5 for forming the dog point thread ridges 22*a* on the dog point 22 of the dog point thread 20. The dog point thread grooves 7 is provided between the two opposite flanks 5*b* of the adjacent dog point thread ridges 5. At the bottom of each groove 7, a root 7*a* of a flat surface is provided to form the crest 22*a* of the dog point 22. As shown in FIG. 3, the height (truncation) hb of the root 7*a* is greater than the height (truncation) 6*a* of the root 6*a*. Thus, the width of the root 7*a* on the dog point rolling surface 3 is greater than the width of the root 6*a* on the thread rolling surface 2.

The crest 5*a* of the dog point thread ridge 5 is higher than the crest 4*a* of the thread portion ridge 4 by a difference Δh1. Further, the root 7*a* of the dog point thread groove 7 is lower than the crest 4*a* of the thread portion ridge 4 by a difference Δh2. Thus, as shown in FIG. 2(*c*), in the dog point thread 20 produced by the thread rolling dies 1 of the present invention, the crest of the dog point thread ridge 22*a* is higher than the root of the thread portion groove 21*b* by a difference ΔH1 and the root of the dog point thread groove 22*b* is lower than the root of the thread portion groove 21*b* by a difference ΔH2.

Preferably, each of the differences Δh1 and Δh2 is more than 0.05 mm and smaller than a half of the height Ha of the thread portion ridge, i.e., Δh1≦Ha/2 and Δh2≦Ha/2. Thus, the size of each of the differences Δh1 and Δh2 is set between about 0.05 mm to 0.3385 mm. For example, the differences Δh1 and Δh2 set in such a way that the height Hb of the dog point thread ridge 5 is smaller than the height Ha of the thread portion ridge 4 (Hb≦Ha) and the height (truncation) ha of the root 6*a* of the thread portion groove 6 is higher than the height (truncation) hb of the root 7*a* of the dog point thread groove 7 (hb≧ha). By setting differences Δh1 and Δh2 within the range noted above, the dog point 22 can smoothly guide the nut, and the like, toward the thread portion 21 of the dog point thread 20.

Further, when determining the differences Δh1 and Δh2, it is preferable to set a difference Δh3 between the root 6*a* and root 7*a* to about 0.02 mm. By setting the difference Δh3 to 0.02 mm in this manner, the dog point 22 of the dog point thread 20 can guide the nut further smoothly. Here, the difference Δh3 is a vertical difference between root 6*a* of the thread portion groove 6 and the root 7*a* of the dog point thread groove 7 in FIG. 3. As shown in FIG. 3, the root 7*a* of the dog point thread groove 7 is higher than the root 6*a* of the thread portion groove 6 by the difference Δh3.

Figure 4A:
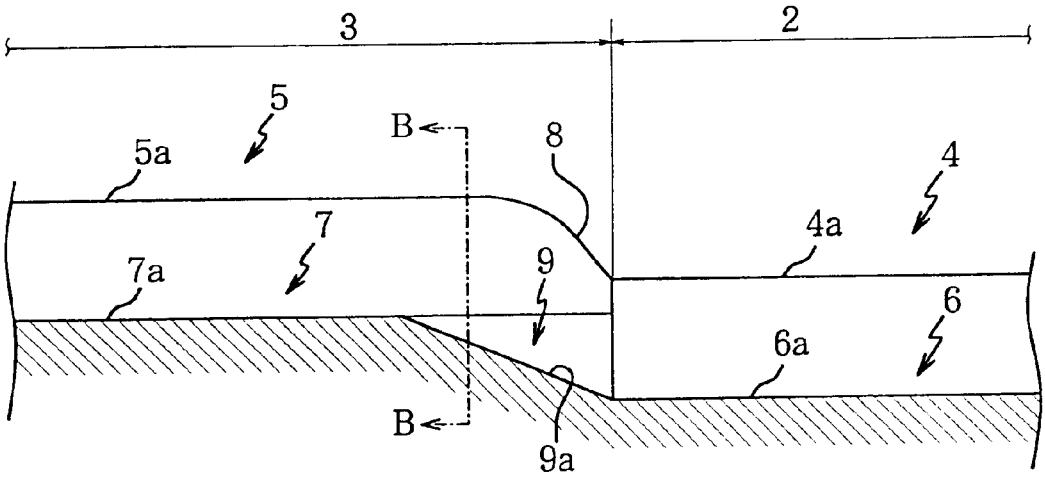
FIG. 4(*a*) is an enlarged partial cross sectional view of the rolling dies of the present invention taken along the IVA—IVA line of FIG. 1(*a*), and FIG. 4(*b*) is a partial cross sectional view of the rolling dies of the present invention taken along the B—B line of FIG. 4(*a*).
Figure 4B:
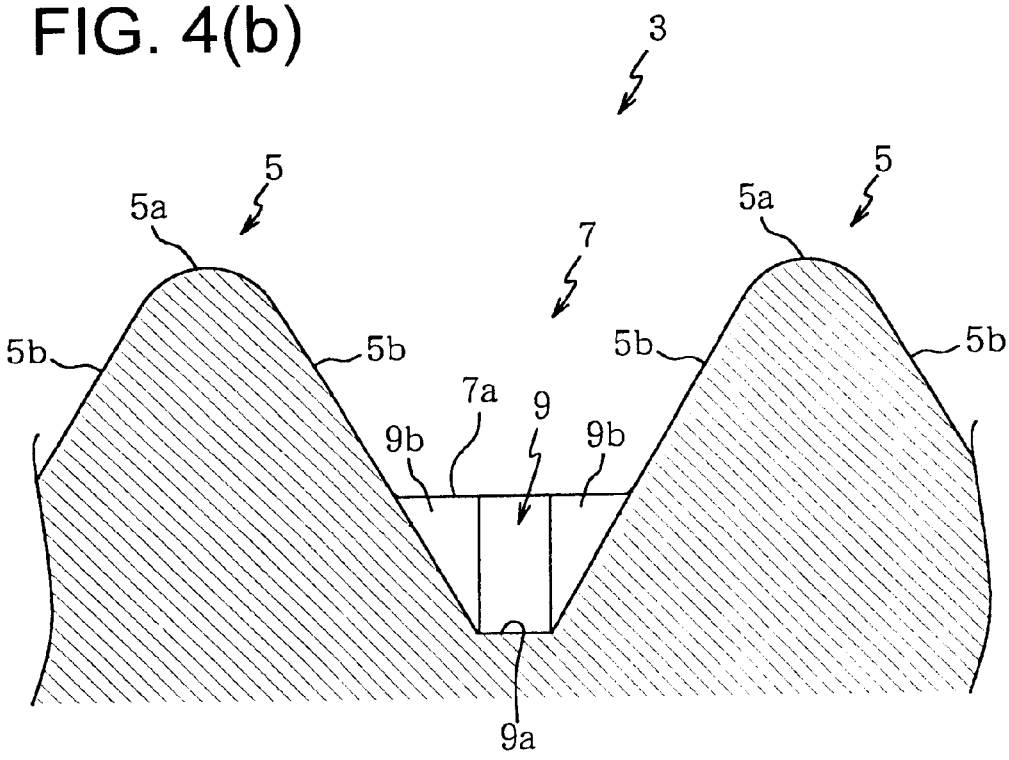

FIG. 4(*a*) is a partial cross section view around the boarder area of the thread rolling surface 2 and the dog point rolling surface 3 of the thread rolling dies 1 taken along the IVA—IVA line of FIG. 1(*a*). FIG. 4(*b*) is a partial cross section view taken along the B—B line of FIG. 4(*a*). As shown in FIG. (4*a* ), the dog point thread ridge 5 has a chamfer 8 having an arc like shape which is extended toward the thread portion rolling surface 2. The chamfer 8 is downwardly inclined from the crest 5*a* of the dog point thread ridge 5 to the crest 4*a* of the thread portion ridge 4. By establishing the chamfer 8 on the dog point thread ridge 5 at the boarder to the thread portion rolling surface 2, in the dog point thread 20, the depth of the groove 23*b* at the boarder area 23 from the dog point 22 to the end point E of the groove 23*b* is gradually decreased. Preferably, a radius of curvature of the chamfer 8 is about 0.1–0.5 mm.

Further in FIG. 4(*a*), the thread rolling dies 1 of the present invention has a connecting groove (cut-out groove) 9 for connecting the thread portion groove 6 with the dog point thread groove 7 for forming the thread ridge 23*a* (FIG. 2(*c*)) at the boarder area 23 on the dog point thread 20. The connecting groove 9 has a root 9*a* which is continuous from the root 6*a* of the thread portion groove 6 and the root 7*a* of the dog point thread groove 7. The root 9*a* is upwardly inclined from the root 6*a* of the thread portion groove 6 to the root 7*a* of the dog point thread groove 7. By establishing the connecting groove 9 having the root 9*a,* in the dog point thread 20, the height of the thread ridge 23*a* at the boarder area from the start point S of the ridge 21*a* to the (complete) thread portion 21 is gradually increased.

As shown in FIG. 4(*b*), the connecting groove 9 has slopes 9*b* at the both sides of the root 9*a*. The two slopes 9*b* and the root 9*a* form a V-shape in cross section based on the outer shape of the boarder ridge 23*a*. Further, the width of the connecting groove 9 gradually decreases from the root 6*a* of the thread portion groove 6 to the root 7*a* of the dog point thread groove 7. By establishing width of the connecting groove 9 in this manner, in the dog point thread 20, the width of the thread ridge 23*a* at the boarder area 23 from the start point S of the thread ridge 21*a* to the thread portion 21 is gradually increased.

As has been described above, according to the thread rolling dies 1 of the present invention, in forming the thread portion 21 of the dog point thread 20 on the outer surface of the work 10 by the thread rolling surface 2, the dog point 22 of the dog point thread 20 is formed by the dog point rolling surface 3 at the same time. The dog point thread groove 22*b* and dog point thread ridge 22*a* are also created on the dog point 22 by the dog point thread ridge 5 and the dog point thread groove 7 on the dog point rolling surface 3.

In the present invention, since the dog point 22 of the dog point thread 20 is formed by the dog point rolling surface 3 of the rolling dies 1 by rolling the dog point thread ridges 5 and dog point thread grooves 7 on the outer surface of the work 10. As a consequence, the slip between the cylindrical body 11 of the work 10 and the dog point rolling surface 3 can be effectively eliminated. Thus, it is possible to effectively avoid damages in the thread portion 21 of the dog point thread 20, such as breakage of thread ridges 21*a* caused by the slip.

In the thread rolling dies 1 of the present invention, the crest 5*a* of the dog point thread ridge 5 is higher than the crest 4*a* of the thread portion ridge 4. The root 7*a* of the dog point thread groove 7 is lower than the crest 4*a* of the thread portion ridge 4 and higher than the root 6*a* of the thread portion groove 6. By the relationship among the ridges 4 and 5 and the grooves 6 and 7 in the thread rolling surface 2 and the dog point rolling surface 3 on the thread rolling dies 1, the rolling process for the thread portion 21 and the dog point 22 of the dog point thread 20 can be performed with high efficiency.

Further, in the dog point rolling surface 3 for forming the dog point 22 of the dog point thread 20, the thread angle a, the pitch, and the lead angle β are designed to be about the same as the thread angle α, the pitch and the lead angle β of the thread rolling surface 2. Because of this dog point rolling surface 3, the resultant dog point 22 of the dog point thread 20 has the ridge angle, pitch and lead angle substantially identical to the respective ridge angle, pitch and lead angle of the thread portion 21.

Accordingly, when the dog point thread 20 is inserted in female threads such as a nut, the ridges 22*a* and grooves 22*b* of the dog point 22 can engage the female threads of the nut and guide the nut toward the thread portion 21. Because the dog point 22 can guide the nut in the manner as noted above, the thread 20 can be easily screwed in the nut by smoothly engaging the ridges 22*a* and grooves 22*b* with the female threads of the nut.

In the foregoing, the present invention has been described with reference to the specific embodiment. However, it is apparent that the present invention is not limited to the above described embodiment but can be modified in various manner without departing from the scope of the invention.

For example, the present invention is described in the above by incorporating specific figures involved in the thread rolling dies 1 for producing metric coarse threads M8×1.25. However, the present invention can be applied to the rolling dies for producing other types of threads such as metric fine threads, inch threads, unified threads, trapezoidal threads, and the like with figures and numerical values appropriate to the types of threads.

Further, in the foregoing example of the thread rolling dies 1, the pitch P of the thread portion ridge 4 and the dog point thread ridge 5 are virtually identical to produce the dog point thread 20 having virtually identical pitch of the thread portion groove 21*b* and the dog point groove 22*b*. However, it is also possible in the thread rolling dies 1 of the present invention that the thread portion groove 6 and the dog point groove 7 are designed to have a virtually identical pitch, i.e., by adjusting the pitch by root, thereby producing the dog point thread 20 having a pitch of the thread portion which is virtually identical to the pitch of the dog point thread ridge 22*a*, i.e, by adjusting the pitch by crest.

In the embodiments described above, the thread angle α of the dog point rolling surface 3 of the rolling dies 1 is virtually identical to the thread angle α of the thread rolling surface 2 for forming the dog point thread 20 having the thread angle of the dog point thread ridge 22*a* virtually identical to the thread angle of the thread portion ridge 21*a*. However, the thread angle of the dog point thread ridge 22*a* and the thread angle of the thread portion ridge 21*a* are not necessarily the same, and it is possible that the thread angle of the dog point thread ridge 22*a* can be smaller than the thread angle of the thread portion ridge 21*a*. For example, the thread angle of the dog point thread ridge 22*a* can be about 50°–55° while the thread angle of the thread portion ridge 21 can be about 60°.

In this example where the thread angle of the dog point thread ridge 22*a* is set smaller than the thread angle of the thread portion ridge 21*a*, the thread angle α of the dog point rolling surface 3 of the rolling dies 1 is set smaller than the thread angle α of the thread portion rolling surface 2. For example, the thread angle α of the dog point rolling surface 3 can be about 50°–55° while the thread angle of the thread portion rolling surface 2 can be about 60°.

Further, in the dog point thread 20, it is also possible to form the thread portion 21 by a metric coarse thread and the dog point 22 by a round thread (knuckle thread) or an electric socket and lamp-base thread). In forming the dog point thread in such a manner, the shapes of the ridges 5 and grooves 7 on the dog point surface 3 of the rolling dies 1 are so configured to establish the ridges and grooves of the round threads or electric socket and lamp-base threads. Here, the round thread is a type of thread having a relatively large radius of curvature in the crest and root of a trapezoidal thread. The electric socket thread is a type of thread to be used as a connector and a receptacle of a light valve, wherein the rounded crests and roots are alternately connected and the radiuses of curvature of the crests and roots are almost the same with one another.

As has been described above, in the first aspect of the present invention, the dog point of the dog point thread is formed by the dog point rolling surface of the rolling dies by rolling the dog point thread ridges and dog point thread grooves on the outer surface of the work. As a consequence, the slip between the outer surface of the work and the dog point rolling surface 3 can be effectively eliminated. Thus, it is possible to effectively avoid damages in the thread portion of the dog point thread, such as breakage of thread ridges caused by the slip.

In the thread rolling dies of the present invention, the crest of the dog point thread ridge is designed higher than the crest of the thread portion ridge. Further, the root of the dog point thread groove is designed lower than the crest of the thread portion ridge. By this relationship among the ridges and the grooves in the thread rolling surface and the dog point rolling surface on the thread rolling dies, the rolling process for the thread portion and the dog point of the dog point thread can be conducted with high efficiency.

Since the ridge height of the dog point thread ridge is shorter than the ridge height of the thread portion ridge 4 as noted above, the resultant ridge height of the dog point thread is shorter than the ridge height of the thread portion ridge of the dog point thread. Accordingly, in the rolling, the rolling amount for the dog point thread ridge on the work is smaller than the rolling amount for the thread portion ridge, thereby capable of reducing the load required for producing the dog point threads.

In the second and third aspects of the present invention, in addition to the effects involved in the first aspect of the invention, the dog point rolling surface for forming the dog point of the dog point thread has the thread angle, the pitch, and the lead angle which are virtually identical to the thread angle, the pitch and the lead angle of the thread rolling surface. Because of this dog point rolling surface, the resultant dog point of the dog point thread has the ridge angle, pitch and lead angle which are substantially identical to the respective ridge angle, pitch and lead angle of the thread portion.

Accordingly, when the dog point thread is inserted in female threads such as a nut, the ridges and grooves of the dog point can engage the female threads of the nut and guide the nut toward the thread portion. Because the dog point can guide the nut in the manner as noted above, the dog point thread can be easily screwed in the nut by smoothly engaging the ridges and grooves with the female threads of the nut.

Especially, in the third aspect of the present invention, in addition to the effects involved in the first and second aspects of the invention, the height difference between the crest of the dog point thread ridge and the crest of the thread portion ridge is more than 0.05 mm and is smaller than a half of the height of the thread portion ridge. Further, the height difference between the root of the dog point thread groove and the root of the thread portion groove is more than 0.05 mm and is smaller than the half of the height of the thread portion ridge. Thus, the resultant dog point thread produced by the rolling dies has the height difference between the crest of the dog point thread ridge and the crest of the thread portion ridge which is more than 0.05 mm and is smaller than a half of the height of the thread portion ridge. Further, the dog point thread has the height difference between the root of the dog point thread groove and the root of the thread portion groove which is more than 0.05 and is smaller than the half of the height of the thread portion ridge. By forming the ridges and grooves in the dog point of the dog point thread in the range described above, dog point can smoothly guide the nut, and the like, toward the thread portion of the dog point thread.

In the fourth aspect of the thread rolling dies of the present invention, in addition to the effects involved in the first to third aspects of the invention noted above, in the boarder area between the thread portion and the dog point formed by the connecting groove (cut-out groove) on the rolling dies, the crest of the dog point ridge gradually increases outwardly until the thread portion ridge. Because the crest of the thread portion ridge gradually increases from the crest of the dog point thread ridge toward the thread portion in the boarder area, when fastening the dog point thread with the nut, it is possible to avoid burning between the boarder area and the inner thread of the nut.

In the fifth aspect of the thread rolling dies of the present invention, in addition to the effects involved in the first to fourth aspects of the invention noted above, in the boarder area between the thread portion and the dog point formed by the connecting groove (cut-out groove) on the rolling dies, the ridge width of the dog point gradually increases until the thread portion. Because the ridge width of the thread portion gradually increases from the dog point thread toward the thread portion in the boarder area, when fastening the dog point thread with the nut, it is possible to avoid burning between the boarder area and the inner thread of the nut.

Although only preferred embodiments are specifically illustrated and described herein, it will be appreciated that many modifications and variations of the present invention are possible in light of the above teachings and within the purview of the appended claims without departing the spirit and intended scope of the invention.

What is claimed is:

1. A thread rolling die for producing a dog point thread by plastic deforming an outer surface of a screw blank where the dog point thread has a thread portion provided with external threads and a dog point having an outer diameter smaller than an outer diameter of the thread portion, comprising, a thread portion rolling surface having a thread portion die ridge for forming a groove of the thread portion of the dog point thread and a thread portion die groove for forming a ridge of the thread portion of the dog point thread; and a dog point rolling surface provided in parallel with the thread rolling surface and having a dog point die ridge for forming a groove of the dog point of the dog point thread and a dog point die groove for forming a ridge of the dog point of the dog point thread;

wherein a crest of the dog point die ridge is positioned higher than a crest of the thread portion die ridge, and a root of the dog point die groove is positioned lower than a root of the crest of the thread portion die ridge, and a distance between the crest and root of the dog point die ridge is smaller than a distance between the crest and root of the thread portion die ridge.

2. A thread rolling die as defined in claim 1, wherein a pitch and a lead angle of the dog point rolling surface are approximately equal to a pitch and a lead angle of the thread portion surface.

3. A thread rolling die as defined in claim 1, wherein a difference of height between the crest of the dog point die ridge and the crest of the thread portion die ridge pitch is larger than about 0.05 mm and is smaller than about a half of the distance between the crest and root of the thread portion die ridge, and wherein a difference of height between the root of the dog point die groove and the crest of the thread portion die ridge is larger than about 0.05 and is smaller than about a half of the distance between the crest and root of the thread portion die ridge.

4. A thread rolling die as defined in claim 1, further comprising a cut-out groove in a boarder area between the thread portion rolling surface and the dog point rolling surface wherein the cut-out groove connects the root of the thread portion die groove and the root of the dog point die groove by upwardly inclining therebetween.

5. A thread rolling die as defined in claim 4, wherein a width of the cut-out groove gradually decreases from the root of the thread portion die groove to the root of the dog point die groove.

* * * * *